US011233307B1

(12) United States Patent
Tsironis

(10) Patent No.: US 11,233,307 B1
(45) Date of Patent: Jan. 25, 2022

(54) DIRECTIONAL WIRE COUPLER FOR WAVEGUIDE TUNERS AND METHOD

(71) Applicant: Christos Tsironis, Dollard-des-Ormeaux (CA)

(72) Inventor: Christos Tsironis, Kirkland (CA)

( * ) Notice: Subject to any disclaimer, the term of this patent is extended or adjusted under 35 U.S.C. 154(b) by 0 days.

(21) Appl. No.: 16/931,021

(22) Filed: Jul. 16, 2020

(51) Int. Cl.
*H01P 5/18* (2006.01)
*H01P 11/00* (2006.01)
*H01P 3/06* (2006.01)

(52) U.S. Cl.
CPC ..... *H01P 5/183* (2013.01); *H01P 3/06* (2013.01); *H01P 11/005* (2013.01)

(58) Field of Classification Search
CPC ..... H01P 5/183; H01P 3/06; H01P 11/005
USPC ..... 333/109
See application file for complete search history.

(56) References Cited

U.S. PATENT DOCUMENTS 3,274,521 A * 9/1966 Nourse ..... H01P 1/195 333/24.1
5,910,754 A 6/1999 Simpson
7,282,926 B1 10/2007 Verspecht et al.
7,548,069 B2 6/2009 Simpson
8,841,921 B1 9/2014 Tsironis
8,896,401 B1 11/2014 Tsironis

OTHER PUBLICATIONS

Directional Couplers [online], Microwaves101 [retrieved on Oct. 17, 2018]. Retrieved from Internet <URL: http://www.microwaves101.com/encyclopedia/directionalcouplers.cfm>.
"Basics of S-Parameters, part 1", Sischka, Franz, Characterization handbook, Mar. 2002.
"An In-Circuit Noncontacting Measurement Method for S-Parameters and Power in Planar Circuits" Stenarson, J. and Yhland K., IEEE Transactions on Microwave Theory and Techniques, vol. 49, No. 12, Dec. 2001, pp. 2567-2572.
"Waveguide loop-type directional coupler using a coupling conductor with protuberances", 2015 European Microwave Conference (EuMC), Paris 2015 https://www.semanticscholar.org/paper/Waveguide-loop-type-directional-coupler-using-a-Ishibashi-Kurihara/8934a277fcd1c7b35ce824eab9642658f29a0228.
What is a Vector Network Analyzer, VNA: the basics, [online], electronics notes [retrieved on Jul. 13, 2020], Retrieved from Internet <URL: https://www.electronics-notes.com/articles/test-methods/rf-vector-network-analyzer-vna/what-is-a-vna.php>.

* cited by examiner

*Primary Examiner* — Robert J Pascal
*Assistant Examiner* — Kimberly E Glenn

(57) ABSTRACT

Wideband waveguide to coaxial low loss signal couplers use an electro-magnetic wire loop inserted perpendicularly in a slot in the top cover of the waveguide transmission line. In order to adapt also to various power levels and associated receiver sensitivity, the coupling factor can be modified by controlling the penetration of the wire loop inside the waveguide cavity. Coupling and Directivity are approximately constant and track over the WR bandwidth up to WR-10. A calibration method allows full characterization of a coupler-tuner assembly.

8 Claims, 11 Drawing Sheets

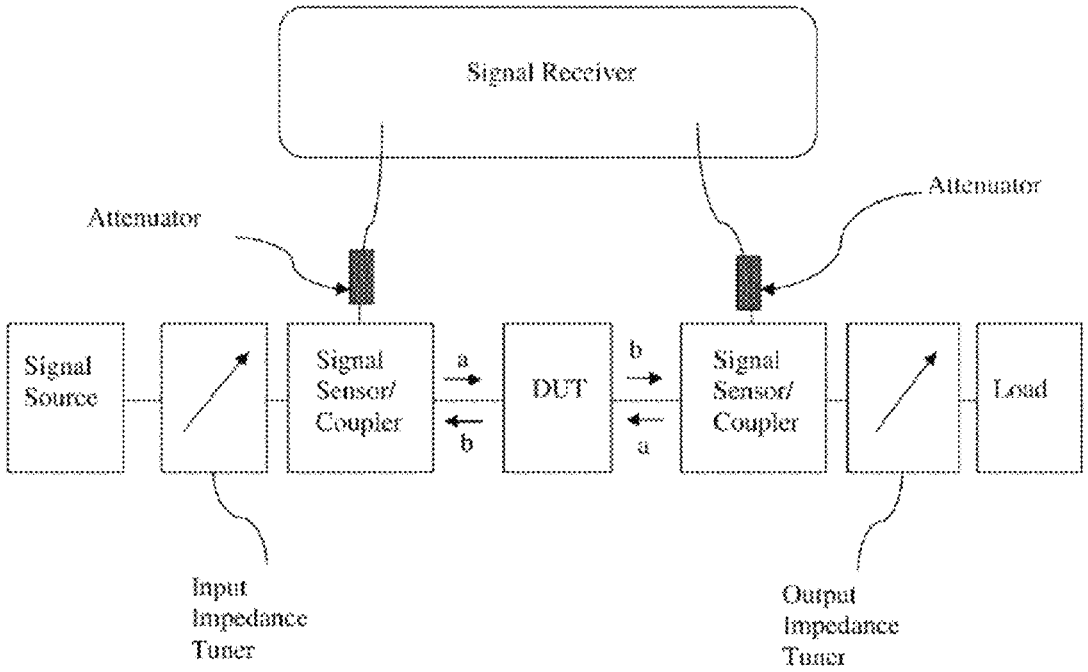
FIG. 1: Prior art

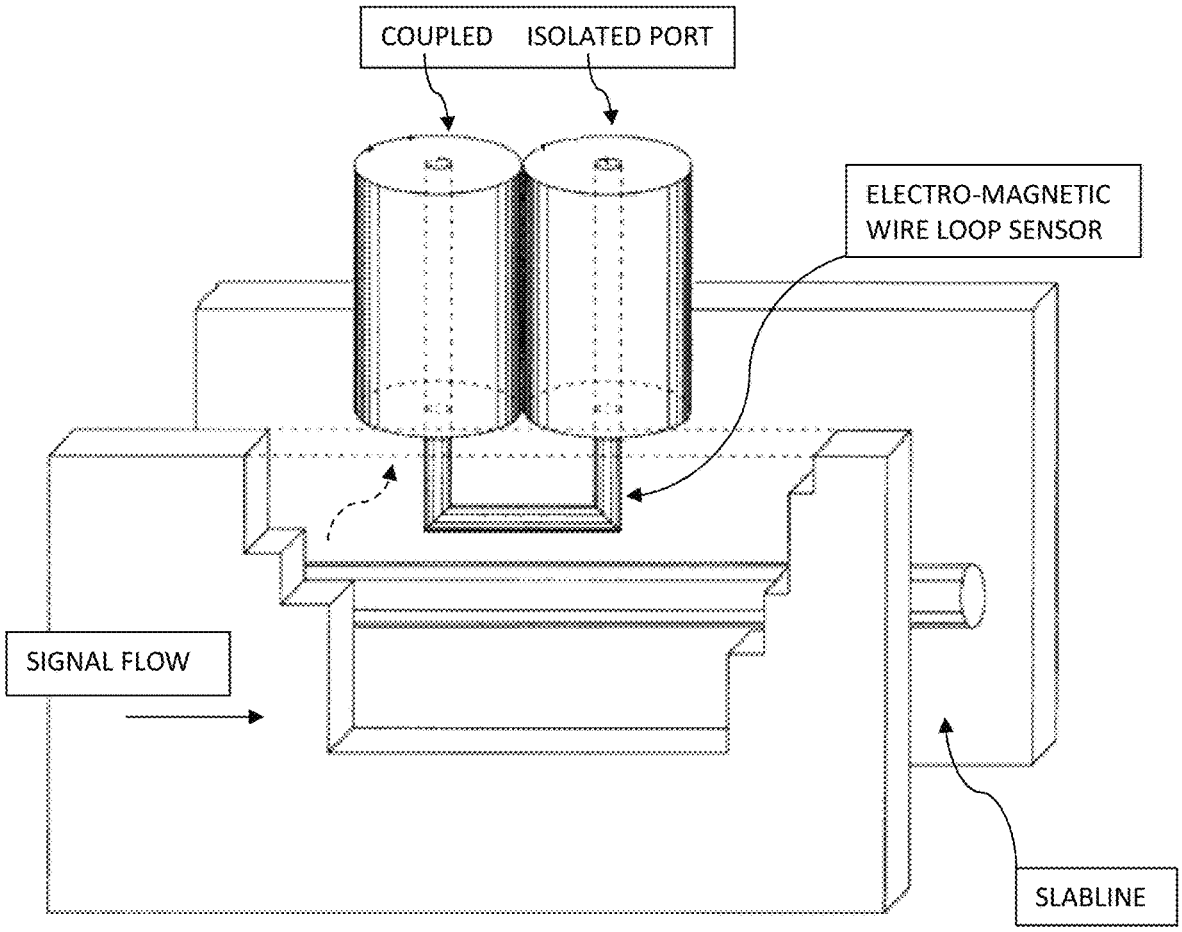
FIG. 2: Prior art

FIG. 3A: Prior art
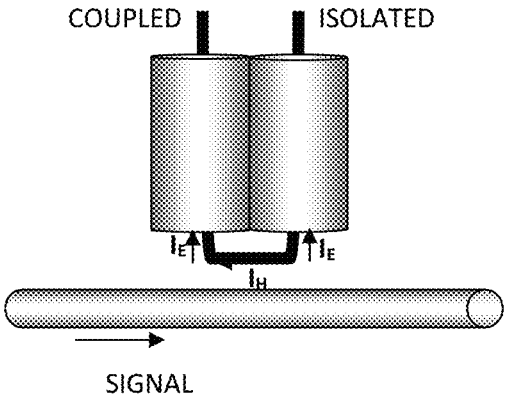
FIG. 3B: Prior art
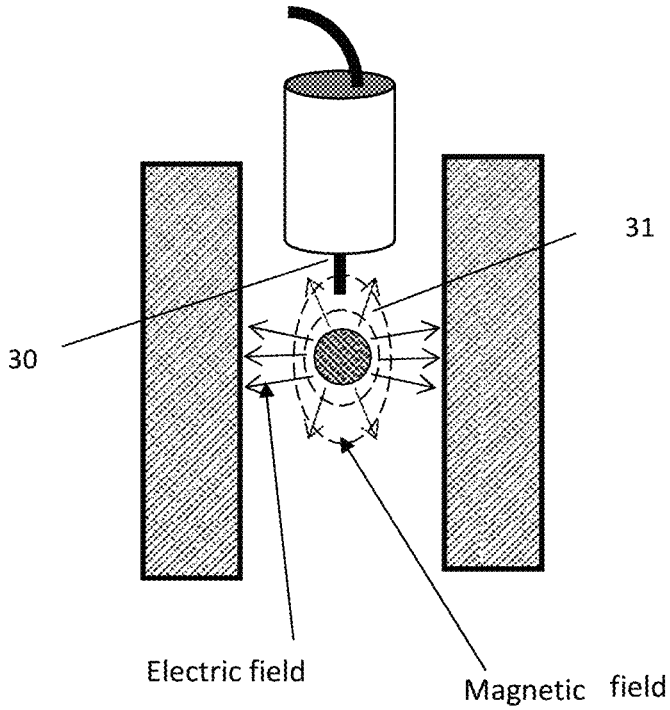

DIRECTIONAL WIRE COUPLER FOR WAVEGUIDE TUNERS AND METHOD

PRIORITY CLAIM

Not Applicable

CROSS-REFERENCE TO RELATED ARTICLES

1. Directional Couplers [online], Microwaves101 [retrieved on 2018-10-17]. Retrieved from Internet <URL: http://www.microwaves101.com/encyclopedia/directionalcouplers.cfm>.
2. "Basics of S-Parameters, part 1", SISCHKA, Franz, Characterization handbook, March 2002.
3. SIMPSON, G. U.S. Pat. No. 7,548,069, "Signal measurement systems and methods".
4. "An In-Circuit Noncontacting Measurement Method for S-Parameters and Power in Planar Circuits" STENARSON, J. and YHLAND K., IEEE Transactions on Microwave Theory and Techniques, Vol. 49, No 12, December 2001, pages 2567-2572.
5. VERSPECHT, J. et al. U.S. Pat. No. 7,282,926, "Method and an apparatus for characterizing a High-Frequency Device-Under-Test in a Large Signal Impedance.
6. "Waveguide loop-type directional coupler using a coupling conductor with protuberances", 2015 European Microwave Conference (EuMC), Paris 2015 https://www.semanticscholar.org/paper/Waveguide-loop-type-directional-coupler-using-a-Ishibashi-Kurihara/8934a277fcd1c7b35ce824eab9642658f29a0228
7. "A Note on Coaxial Bethe-Hole Directional Couplers", in Proceedings of the IRE, https://ieeexplore.ieee.org/abstract/document/1701224.
8. Simpson, G. et al: U.S. Pat. No. 5,910,754, "Reduced height waveguide tuner for impedance matching".
9. TSIRONIS, C. U.S. Pat. No. 8,841,921, "Adjustable signal sampling sensor and method".
10. TSIRONIS, C. U.S. Pat. No. 8,896,401, "Calibration and tuning using compact multi frequency-range impedance tuners".
11. "What is a Vector Network Analyzer, VNA: the basics, [online], electronics notes [retrieved on 2020 Jul. 13]. Retrieved from Internet <URL: https://www.electronics-notes.com/articles/test-methods/rf-vector-network-analyzer-vna/what-is-a-vna.php>.

BACKGROUND OF THE INVENTION

This invention relates to millimeter-wave testing of transistors (device under test: DUT). The electrical signals injected into the input of the DUT and extracted from the output can be sampled and measured using signal sampling devices (directional couplers, see ref. 1), such as, but not exclusively, wave-probes (see ref. 5) or IV probes (see ref. 3, 4) and processed by appropriate signal analyzers (see ref. 11).

DESCRIPTION OF PRIOR ART

A typical test setup allowing sampling electrical signals at the input and output of a DUT in linear and nonlinear operation regime is shown in FIG. 1. In this setup the source and load impedances are nominally 50Ω (the standard characteristic impedance Zo of microwave transmission lines). The input and output signal couplers (FIG. 2, see ref. 9) extract a small portion of the RF power waves a(t) and b(t) which are injected into and extracted from the DUT and transfers them into the tuned signal receiver (Vector Network Analyzer, VNA, see ref. 11), which measures the fundamental and harmonic components of it and may display the RF characteristics as well as the time function, using frequency-to-time inverse Fourier transformation.

Directional signal couplers have been known for a long time (see ref. 6, 7). Waveguide directional couplers use sections of waveguide transmission lines and slots or a number of holes to allow small amounts of energy to excite wave generation into the secondary adjacent waveguide (see ref. 7). The form, size and positioning of the slots and holes allows various coupling values. The main disadvantage of waveguide-to-waveguide couplers is their big size, and because of that and also because of the fact that, coaxial transmission line and connector technology has reached well into the previously exclusive domain of millimeter-wave frequencies up to and above 110 GHz, a new coaxial solution became imaginable. Such wideband, covering at least a full waveguide bandwidth (such as, but not limited to, 12-18, 18-26.5, 26.5-40, 40-60, 60-90 and 75-110 GHz) directional coaxial type wire couplers for rectangular waveguides have not yet been known in the art.

BRIEF DESCRIPTION OF THE INVENTION

This invention discloses a compact, wideband, integrated rectangular waveguide to coaxial directional signal coupler. The signal coupler is made of micro-coaxial semi-rigid cable of which the shielding mantle and dielectric core (typically Teflon) has been removed over a short section and the cable is folded at this section, exposing the center conductor in "U" form (FIGS. 3A, 5A and 5B). The folded cable with the "U" section in front is inserted in a short slot 50 into the top wall of the rectangular waveguide and penetrates into the cavity, such that the exposed "U" center conductor segment creates a loop sensor and is coupled electromagnetically with the TE10 mode signal travelling along the waveguide. The electrically and magnetically induced currents $I_H$ and $I_E$ add in the coupled branch of the coupler and subtract in the isolated branch (FIG. 3A). The difference between the energy delivered at the two ports (directivity) of the coupler in the waveguide transmission line environment is a key element of the new device and comparable with the original directional couplers made in parallel-plate (slabline) environment (FIG. 2). The structure is best suited for integration with waveguide slide screw impedance tuners (see ref. 8). In the following we use the term "coupler", "directional coupler", "signal coupler" or "wire coupler" in equal terms, describing the same device. When loaded at the input or output port with impedance other than Zo (50Ω) the coupling behavior changes because, some signal reflected at the mismatched port leaks, through the finite directivity, into the coupled and isolated ports 3 and 4 and must be accounted for using appropriate calibration method.

The modal electric (E) and magnetic (H) fields inside the rectangular waveguide induce surface charges and surface currents (J) on the walls of the waveguide (FIG. 4). Since the surface currents are related to tangential components of magnetic fields first, we obtain the distribution of magnetic fields on the walls of the waveguide shown relative to the wire loop sensor creating the directional coupling effect.

BRIEF DESCRIPTION OF THE SEVERAL VIEWS OF THE DRAWINGS

The invention and its mode of operation will be more clearly understood from the following detailed description when read with the appended drawings in which:

FIG. 1 depicts prior art, a signal measurement system using impedance tuners and signal couplers.

FIG. 2 depicts prior art, the concept of the wave-probe type directional signal coupler in a (coaxial) slabline (see ref. 5).

FIG. 3A through 3B depict prior art: field distribution in a (coaxial) slabline-based wave-probe; FIG. 3A depicts electric field front view; FIG. 3B depicts electric and magnetic field cross section.

FIG. 5A depicts a 3D view; FIG. 5B depicts a cross section.

FIG. 10A depicts a cross section and definitions; FIG. 10B depicts coupling; FIG. 10C depicts isolation.

DETAILED DESCRIPTION OF THE INVENTION

Electro-magnetically coupled wire sensors for signal detection have been disclosed and used before (see ref. 5 and FIGS. 2 and 3). In prior art the signal couplers are inserted in coaxial, parallel plate (slabline) or cylindrical, configuration (see ref. 5, FIG. 2). The advantage of a slabline-based wire coupler is that the wire loop 30 can be inserted from the open top and there is no need for machining (drilling) the airline mantle to insert it into a hole; but there are mechanical and electrical shortcomings as well, such as the requirement for additional support hardware for the wire-loop and extension cables, and a weaker efficiency, because the electric field vertically 31 in FIG. 3B is weak, compared with the stronger horizontal electric field. To reach high coupling, a slabline loop 30 must penetrate deep into the slabline and be very close to the center conductor risking the creation of higher field disturbance and residual reflection factor.

Figure 5A:
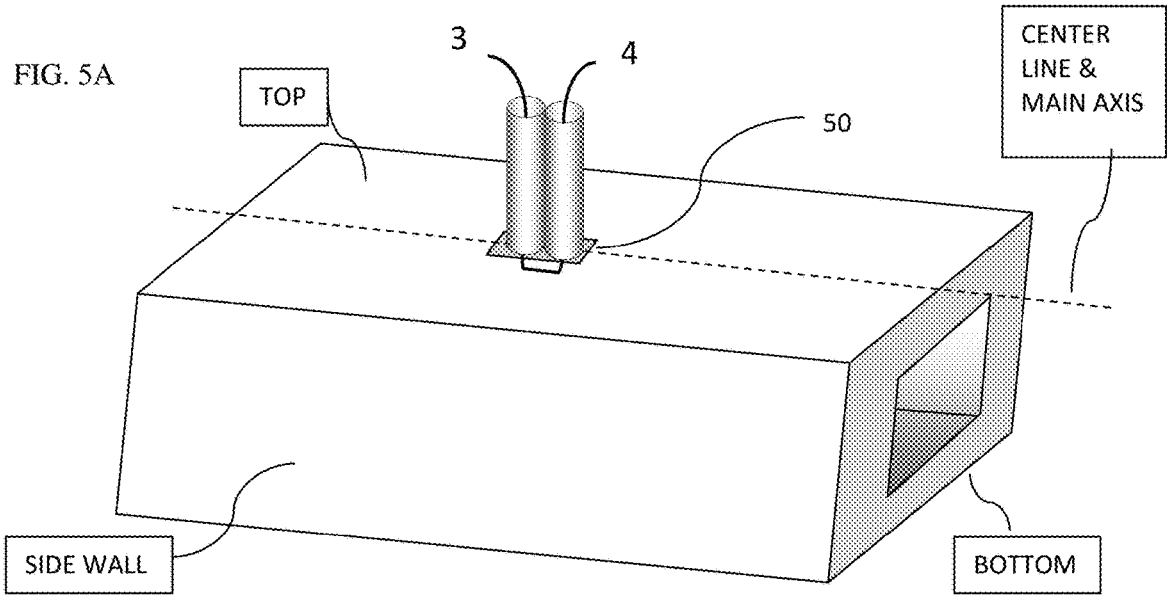
FIG. 5A through 5B depict the wire coupler for rectangular waveguides.
Figure 5B:
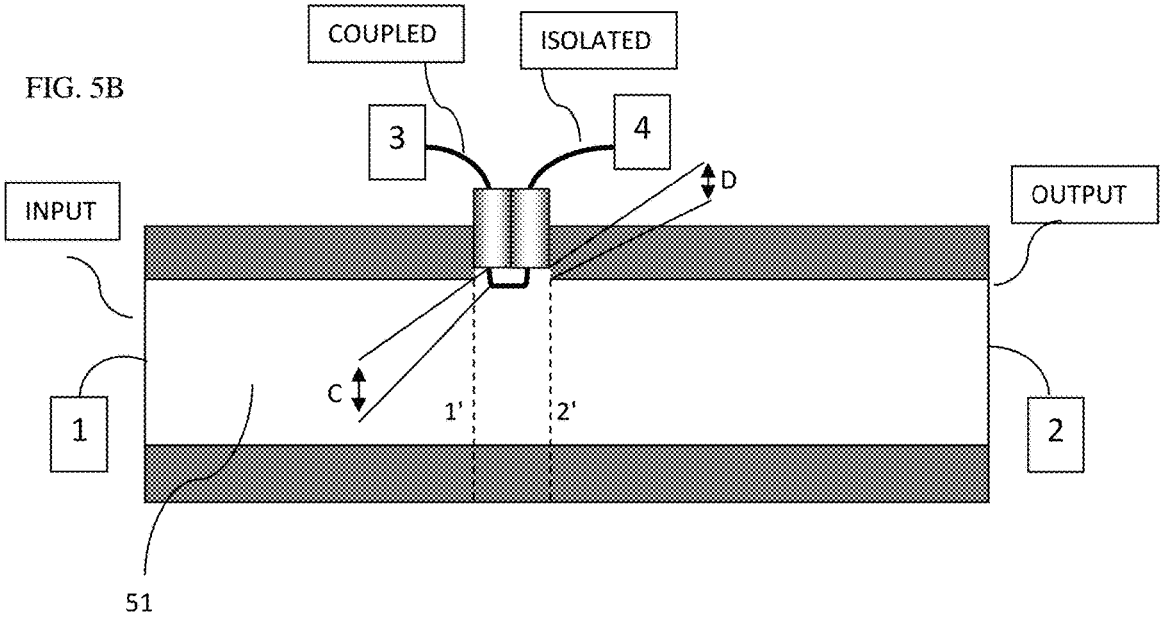

Isolation (S41), see ref. 5 and FIGS. 3A and 5B in a wire-loop sensor is created because the capacitively induced electric current $I_E$ and magnetically induced current $I_H$ in each of the two branches of the wire-loop coupler run either together (in the coupled branch) or opposite (in the isolated branch); this creates an imbalance and leads to the "desired" directivity. The currents cannot be measured directly, only the signal ratio between the total signal at the coupled and isolated port terminations can be measured and it is proportional to the ratio $(I_E+I_H)/(I_H-I_E)$.

Figure 4:
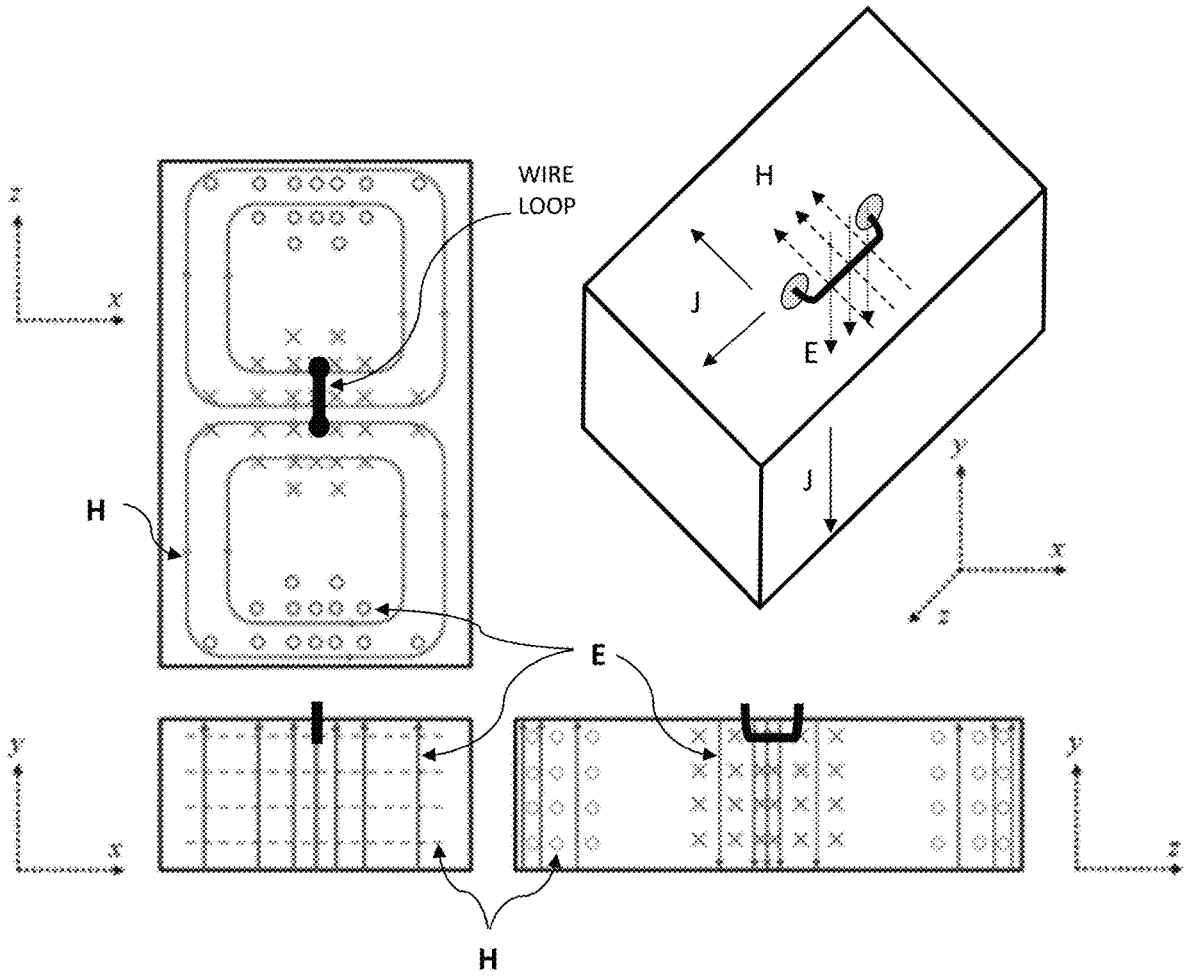
FIG. 4 depicts views and electric E and magnetic H field lines in TE10 waveguide propagation as well as surface currents J and coupling mechanism of wire coupler.

Transverse electric TE10 electro-magnetic wave propagation mode is schematically shown in FIG. 4. The wire-loop is centered on the top (or bottom) of the rectangular waveguide and vertically contactless inserted. It is magnetically coupled by the looping magnetic field H and is subject to electrical current induction by the vertical electric field E in a coupling mechanism equivalent to FIG. 3A. It is expected, therefore, that a similar coupling behavior would occur, which in fact happens.

Figure 8:
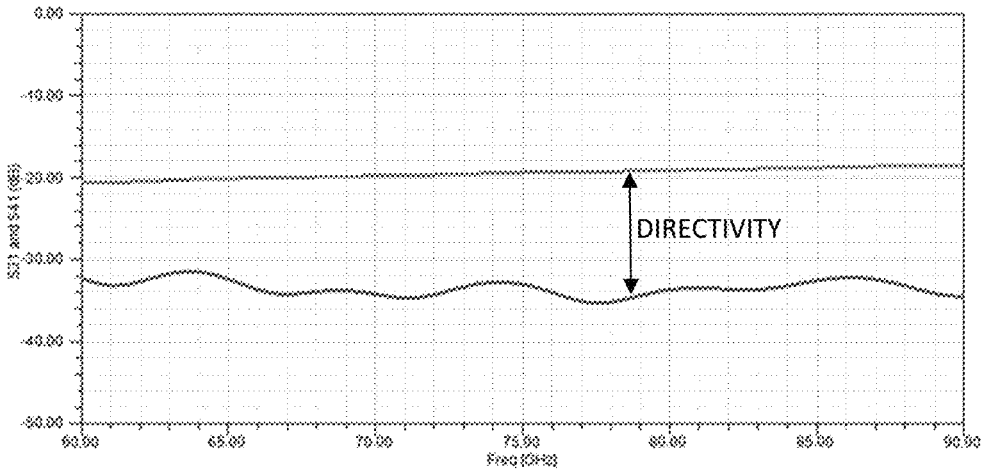
FIG. 8 depicts coupling (S31=S42) and isolation (S41=S32) of the wire-based signal coupler in waveguide as a function of frequency.
Figure 9:
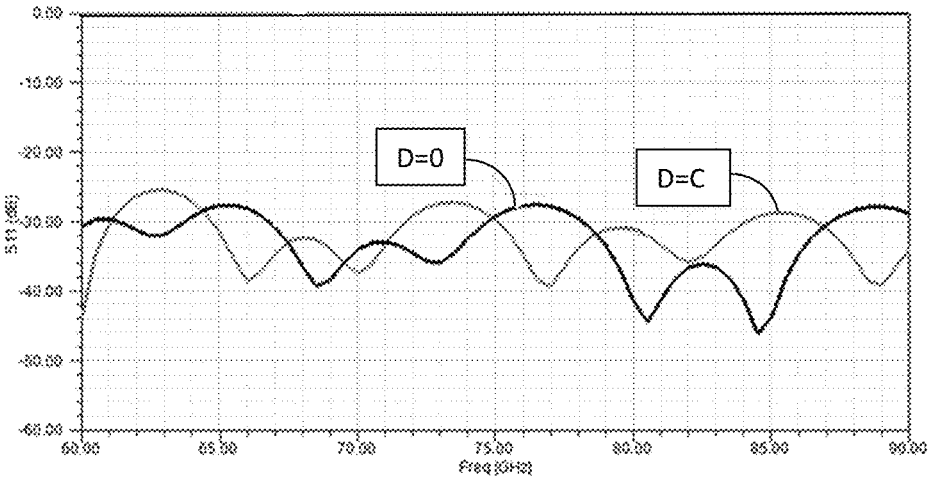
FIG. 9 depicts frequency dependence of residual reflection of the wire-based signal coupler in waveguide as a function of penetration of the wire loop into the waveguide cavity.

FIG. 5 shows the basic embodiment of the wire-loop signal coupler for waveguide transmission line. Input and output port definition is arbitrary along the waveguide, it can be external as shown here as ports 1 and 2 or internal, marked as 1' and 2'. Coupled 3 and isolated 4 ports are, in all cases, defined as the ends of the two branches of the wire-loop which has a bottom section and the two branches, which continue as center conductor of coaxial cables and terminate to the coupled and isolated ports. Once the positioning of the slot 50 on the top wall of the waveguide is settled, the only adjustability of the coupler remains the contactless penetration depth of the wire loop (FIG. 5B) shown as D; the critical dimension here is the protrusion C of the wire loop outside the mantle of the coaxial cable. The sensor can be meaningfully inserted for maximum coupling up to D=0 and extracted for minimum distraction of the field up to D=C, whereby C is the actual protrusion of the wire loop beyond the mantle of the coaxial cable; or for D=C the wire loop will be flash with the internal waveguide wall; results for coupling (S31=S42), isolation (S41=S32), directivity (=S31/S41) and residual reflection for cases D=0 or D=C are shown in FIGS. 8 and 9. Further penetration of the wire loop is not recommended, because it disturbs the field and creates non-negligible residual reflection.

Figure 6:
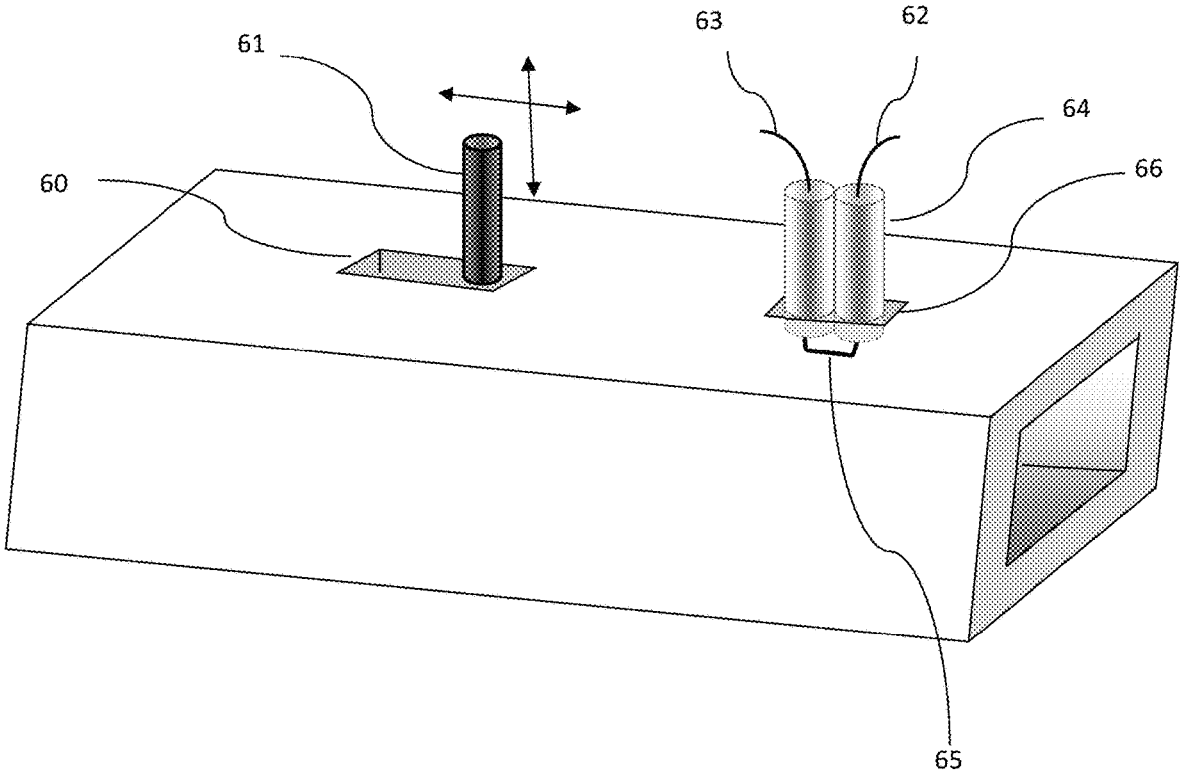
FIG. 6 depicts a 3D view of the "signal coupler-impedance tuner" assembly in waveguide environment.
Figure 7:
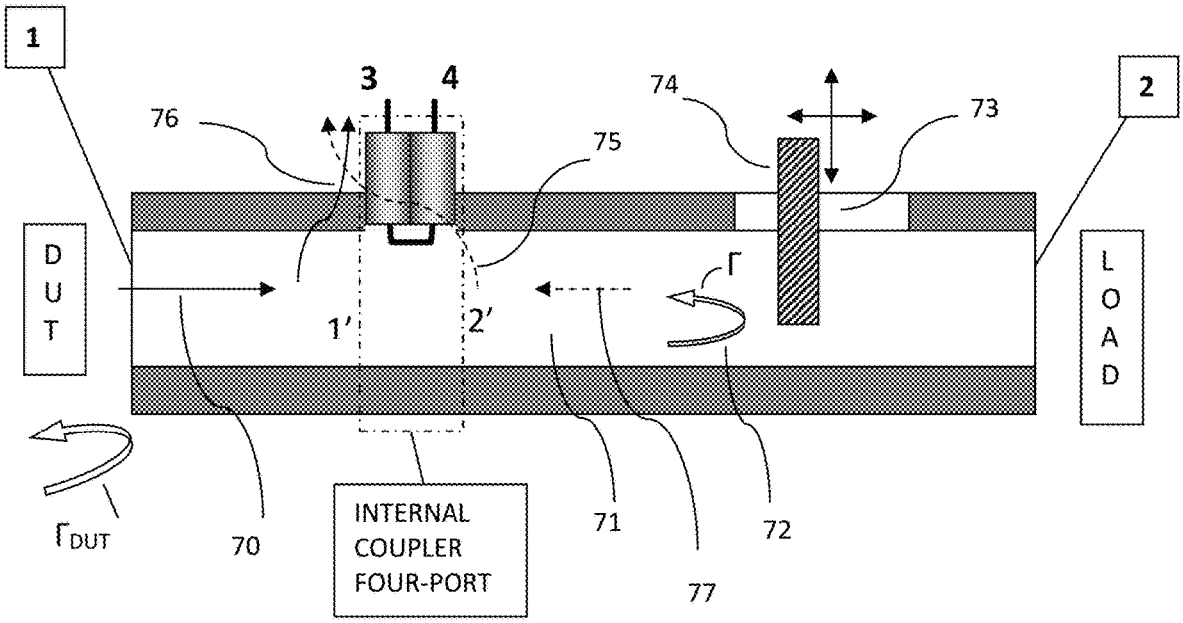
FIG. 7 depicts a cross section of the "signal coupler-impedance tuner" assembly in waveguide environment.

Directional signal couplers are also used in impedance related testing, generally known as load or source pull. In such test setups, as shown in prior art FIG. 1, the tuner is attached to the coupler, or, for economy of space and better tuning range (maximum tunable reflection factor) the coupler is integrated with the tuner. Such an embodiment for a waveguide tuner is shown in FIGS. 6 and 7: In FIG. 6 the waveguide has two slots 60 and 66; in slot 60 there is a tuning probe (conductive rod) 61 inserted and movable vertically into the slot and horizontally along the waveguide. Vertical penetration controls the amplitude and horizontal movement controls the phase of the reflection factor of the tuner. In the other slot 66 there is the wire coupler inserted. It includes the wire loop 65 and the leading coaxial cables 64 terminating at the coupled 62 and isolated 63 coupler ports.

A more detailed operation and definitions of the coupler-tuner assembly is shown in FIG. 7: the waveguide transmission line 71 has an input or test port 1 to which the DUT is connected, and an output port 2 connected to the load. The signal 70 flows from the DUT to the load. At the internal coupler port 1' a small portion of the signal (typically 1%) is coupled 76 into the coupled port 3 of the wire coupler; the remaining signal power continues until the tuner section and is reflected 72 at the tuning probe 74, which is inserted and manipulated inside the slot 73. This reflected signal 77 reaches the wire coupler and leaks back 75 into the coupled port 3 and is added to the original coupled signal 76; accurate measurement through the coupler requires knowledge of this phenomenon. This leakage phenomenon leads to the following relation for the effective coupling factor C31'(Γ) between ports 1' and 3:

$$C31'(\Gamma)=S31'+S41'*S21'*\Gamma(1-\Gamma*S22')\approx S31'+S41'*\Gamma \quad \{eq.\ 1\}$$

This simply means two things: a) that at Γ=0 the coupling is equal to the s-parameter S31' and b) that for medium to low directivity S31'/S41' the presence of Γ must be corrected for.

It would be possible to apply eq. 1 to correct C31', if S31' and Γ were known. But in the integrated assembly, not only the real requirement is the external coupling factor C31 and not the internal C31', but also both the internal S31' and Γ are unknown and cannot be measured. The low insertion loss of the waveguide might tempt one to estimate, with acceptable accuracy, the effective amplitude of |S31'| and |Γ|, but, since all signals dealt with here are vectors having amplitude and phase, lag of phase information is unacceptable. Therefore, a different method must be found yielding the really needed information, i.e. an adequate system calibration.

Calibration means before-hand characterization of a measurement instrument, or device, and save the data in a way that can be recalled and referred to later. Impedance tuners, in general, are calibrated by measuring their two-port s-parameters from the input (test) port to the output (idle) port for a multitude of tuning probe positions, ideally the test port reflection factor S11 covering the whole or a large part of the reflection factor plan (Smith Chart), save and recall the data (see ref. 10). The quantity of interest in the particular case of the couple-tuner assembly of FIG. 7 is, beyond the reflection factor S11 and tuner loss $(1-|S11|^2)/|S21|^2$, the coupling and isolation factor C31 as a function of the reflection factor Γ as shown in eq. 1. As already explained, because the ports 1', 2' and the value of γ at its reference plane are inaccessible, a direct characterization of the internal coupler four-port (FIG. 7) is impossible. But this is irrelevant. What the measurement system needs to measure is the power "generated by" the DUT and the reflection factor "seen by" the DUT. This can be done at port 1 without further knowledge of the internal mechanism of the assembly. By measuring four-port s-parameters Sij=S11, S12 . . . to S44 between the external ports 1 to 4 of the assembly as a function of the tuning probe positions the whole system is characterized and calibrated. This line of thought is valid but not obvious, as a first reaction would be to characterize the coupler and tuner separately and compute the combination using theory as described by eq. 1. However, by scrutinizing the real requirement, we reach the conclusion that this, impossible, step is not even required.

Figure 11:
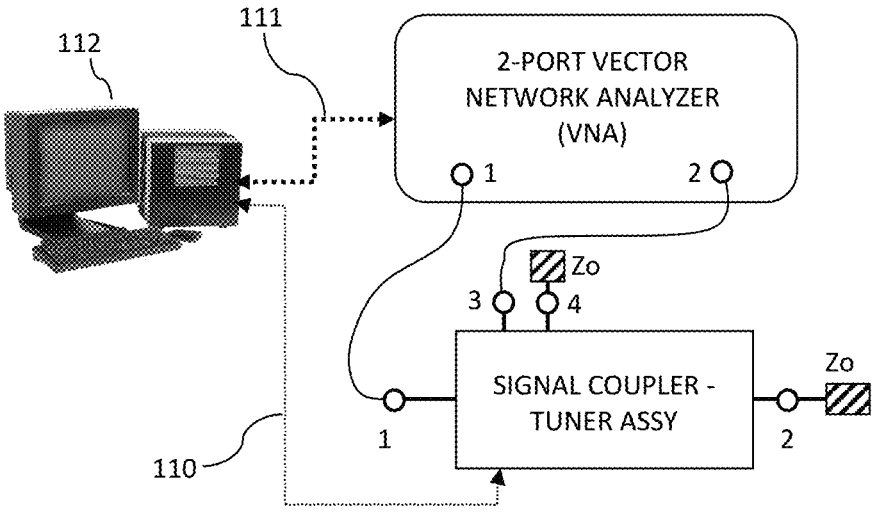
FIG. 11 depicts an automatic calibration setup for the "signal coupler-tuner assembly" on two-port vector network analyzer (VNA).

Calibration requires a pre-calibrated vector network analyzer (VNA) (see ref. 11), connected 111 with a system controller 112. There are two basic types of VNA, two-port VNA's having ports 1 and 2 and four-port VNA's having ports 1 to 4; when using a four-port VNA the calibration is simpler, because the four ports 1 to 4 of the coupler-tuner assembly are directly connected to the corresponding VNA ports and the four-port s-parameters are measured and saved in one operation as a function of a selected multitude of tuning probe positions. When using a simpler two-port VNA, the calibration procedure becomes more tedious (FIG. 11), because each time two of the four coupler-tuner assembly ports are connected to the VNA ports while the other two must be terminated with Zo (50Ω). In fact, s-parameters (see ref. 2) between the coupled and isolated ports 3 and 4 are not required for the operation, since these two ports are always Zo terminated and there is no signal power reflected to falsify the measurement. In summary a four-port VNA requires connecting and measuring once, whereas a two-port VNA requires connecting five, instead of six, times ({A-B}={1-2, 1-3, 1-4, 2-3, 2-4}) each time terminating the other two ports with Zo, measuring two-port s-parameters for the same set of tuning probe settings and saving in corresponding AB files. At the end the s-parameters of the AB files are concatenated to a total ABCD calibration file including 5 sets of four s-parameters to a total of 20 s-parameters. In the case of a four-port VNA, s-parameter measuring and saving also s-parameters between ports 3 and 4 is a free bonus that does not cost considerable extra time. Most of the inconvenience when using two-port VNA is the connecting disconnecting time and the 5-fold longer tuning probe positioning and measuring, in addition to unavoidable mechanical repeatability errors in positioning and re-positioning the tuning probe.

Figure 10A:
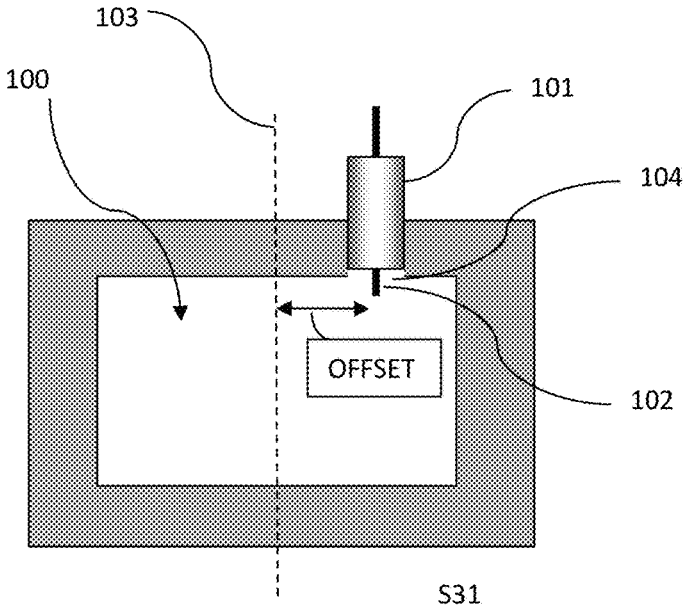
FIG. 10A through 10C depict the dependence of coupling and isolation on OFFSET positioning of the wire loop in the waveguide as a function of frequency.
Figure 10B:
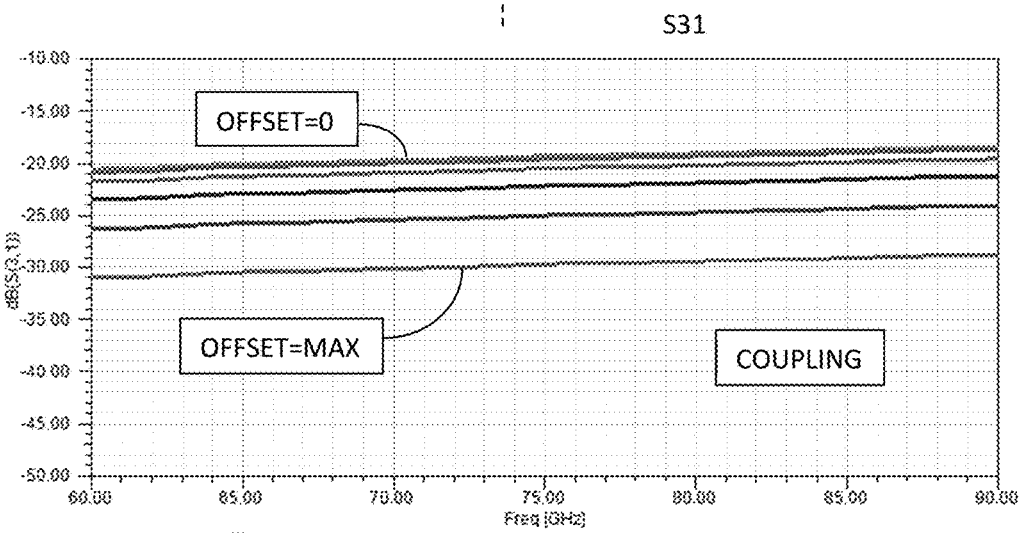
Figure 10C:
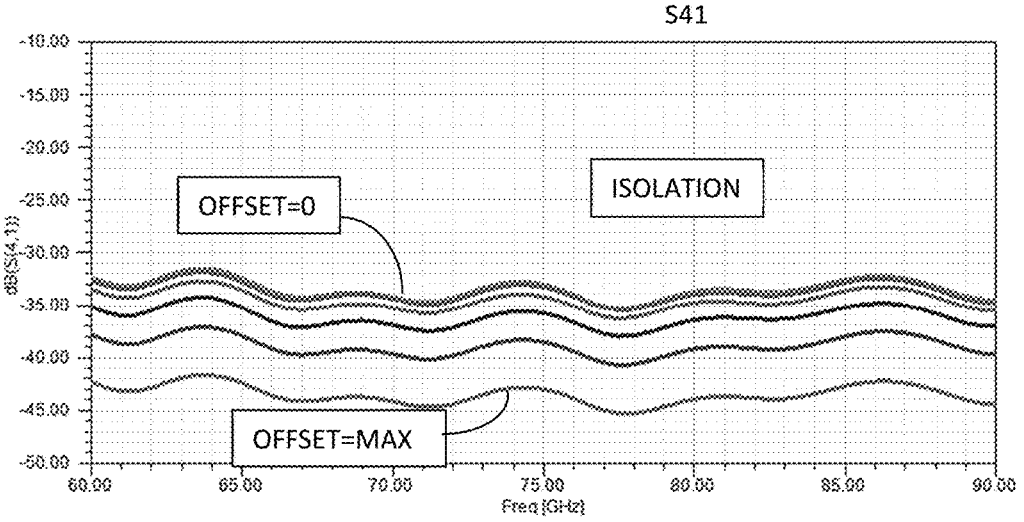

The coupling and isolation characteristics of the wire coupler can be statically modified (not dynamically adjusted). Modification is permanent. It depends on the position of the slot 104 the coupler cable itself 101 and the wire loop 102 relative to the center line 103 of the waveguide 100, as shown in FIG. 10A. FIG. 10B shows the coupling factor in the frequency range of 60-90 GHz (waveguide type WR-12) as a function of OFFSET. Maximum coupling (FIG. 10B) occurs when the wire loop is centered on the waveguide (OFFSET=0) and minimum coupling occurs when the wire loop is as close to the side wall as mechanically possible (OFFSET=MAX). Isolation (FIG. 10C) follows a similar pattern: Minimum at center, maximum at the side wall. It it noticeable that the directivity while coupling changes by roughly 10 to 12 dB on average the directivity (COUPLING-ISOLATION (in dB)) remains roughly constant 12 and 15 dB. This is the result of both magnetic and electric coupling currents getting weaker in unison as the wire coupler shifts sidewise.

Obvious alternatives of the disclosed embodiments of the wire-coupler for waveguides shall not impede on the reach of the invention. Obviously modified or re-arranged algorithms for calibration and for arranging the internal reference planes of the assembly shall not impede on the invention itself.

What is claimed is:

1. A wideband waveguide to coaxial directional signal coupler comprising:

a section of low loss rectangular waveguide transmission line, input port, output port, coupled port and isolated port and an electromagnetic "U" form loop sensor, said waveguide transmission line having a main axis, wide top and bottom walls and two narrow side walls, and said U-form electro-magnetic loop sensor having a bottom section and two branches, wherein one end of the waveguide transmission line is the input port, and the other end is the output port, wherein the loop sensor penetrates contactless perpendicularly into a hole on the top wall of the waveguide transmission line, and wherein the bottom section of the U-formed sensor is parallel to the main axis of the waveguide transmission line and its branches extend into forming center conductors of coaxial cables, one of the coaxial cables leading to the coupled port and the other one of the coaxial cables leading to the isolated port.

2. The directional signal coupler of claim 1, wherein the hole is placed on the top wall, centered relative to the main axis.

3. The directional signal coupler of claim 1, wherein the penetration of the U-formed sensor into the hole is modifiable.

4. The directional signal coupler of claim 1, wherein the hole on the top wall is placed offset relative to the main axis.

5. A signal coupler-waveguide tuner assembly comprising:

a cascade of the wideband signal coupler as in claim 1 and a waveguide impedance tuner, both sharing the same waveguide transmission line, said tuner having input and output ports and comprising:

a remotely controlled reflective tuning probe insertable vertically (perpendicular) and movable horizontally (parallel) to the axis of the waveguide, inside a slot in the waveguide top wall, placed between the input and output ports of the tuner, wherein a test port (1) of the assembly is the input port of the coupler, an output port (2) of the assembly is the output port of the tuner and the coupling port (3) and isolated port (4) of the assembly are the coupled and isolated ports of the signal coupler correspondingly.

6. A calibration method for signal coupler-tuner assembly as in claim 5, comprising the following steps:

a) connect the coupler-tuner assembly to a pre-calibrated four-port vector network analyzer (VNA) as follows:

a1) the test port of the assembly to a first port of the VNA;

a2) the output port of the assembly to a second port of the VNA;

a3) the coupled port of the assembly to a third port of the VNA;

a4) the isolated port of the assembly to a fourth port of the VNA;

b) measure s-parameters Sij for {i,j}={1,4} for a multitude of horizontal and vertical positions of the tuning probe and save in a calibration file for later use.

7. A calibration method for signal coupler-tuner assembly as in claim 5, wherein a port M is one of the ports 1 to 4 and a port N is one of the ports 1 to 4 of the coupler-tuner assembly, comprising:

connecting the ports M and N of the coupler-tuner assembly to ports 1 and 2 of a pre-calibrated two-port vector network analyzer (VNA), measuring and saving s-parameters for a multitude of horizontal and vertical positions of the tuning probe as follows:

in a measurement loop a) connect ports M and N for {M,N}={1,4}, with M≠N, to the VNA ports 1 and 2;

b) terminate the remaining ports of the coupler-tuner assembly with characteristic impedance Zo;

c) measure s-parameters Sij for {i,j}={1,2} for the multitude of horizontal and vertical tuning probe positions;

d) save in calibration file MN;

terminate the calibration by concatenating the s-parameters of all files MN and save in a calibration file for later use.

8. The coupler-tuner assembly of claim 5, wherein the slot in the waveguide top wall has a length, parallel to the axis of the waveguide, at least one half of the wavelength at a lowest frequency of operation.

* * * * *